US012281527B2

(12) United States Patent
Wakerley et al.

(10) Patent No.: US 12,281,527 B2
(45) **Date of Patent: *Apr. 22, 2025**

(54) CONTROL LINE ACTIVATED TUBING DISCONNECT LATCH SYSTEM

(71) Applicant: Schlumberger Technology Corporation, Sugar Land, TX (US)

(72) Inventors: Thomas James Wakerley, Rio de Janeiro (BR); Krishna Trisal, Houston, TX (US); Farid Afandiyev, Mussafah (AE); Ilyana Sergeevna Afanasyeva, Yuzhno-Sakhalinsk (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/401,816

(22) Filed: Jan. 2, 2024

(65) Prior Publication Data

US 2024/0209703 A1 Jun. 27, 2024

Related U.S. Application Data

(63) Continuation of application No. 17/756,946, filed as application No. PCT/RU2019/000953 on Dec. 16, 2019, now Pat. No. 11,885,187.

(51) Int. Cl.
*E21B 17/06* (2006.01)
*E21B 23/04* (2006.01)

(52) U.S. Cl.
CPC ..... *E21B 23/042* (2020.05); *E21B 17/06* (2013.01); *E21B 23/0412* (2020.05)

(58) Field of Classification Search
CPC ..... E21B 17/06; E21B 23/04; E21B 23/042; E21B 23/04115
See application file for complete search history.

(56) References Cited

U.S. PATENT DOCUMENTS

| | | | |
|---|---|---|---|
| 5,242,201 | A | 9/1993 | Beeman |
| 5,323,853 | A | 6/1994 | Leismer et al. |
| 5,526,888 | A | 6/1996 | Gazewood |
| 7,353,871 | B2 | 4/2008 | Hromas |
| 8,752,635 | B2 | 6/2014 | Wang |
| 8,974,311 | B2 | 3/2015 | Motz |
| 9,869,157 | B2 | 1/2018 | Sevadjian et al. |
| 11,885,187 | B2 * | 1/2024 | Wakerley ..... E21B 23/042 |

(Continued)

FOREIGN PATENT DOCUMENTS

| | | |
|---|---|---|
| RU | 2186930 C2 | 8/2002 |
| RU | 2203385 C2 | 4/2003 |

(Continued)

OTHER PUBLICATIONS

International Search Report and Written Opinion of PCT Application No. PCT/RU2019/000953, dated Sep. 10, 2020 (8 pages).

(Continued)

*Primary Examiner* — Giovanna Wright
(74) *Attorney, Agent, or Firm* — Jeffrey D. Frantz

(57) ABSTRACT

A method and apparatus are disclosed that use a control line to expand a piston that shears pins to disconnect a latching system for wellbore operations.

20 Claims, 6 Drawing Sheets

(56) References Cited

U.S. PATENT DOCUMENTS

| | | | | |
|---|---|---|---|---|
| 2009/0078429 | A1* | 3/2009 | Du | H01R 13/533 166/66.4 |
| 2013/0048307 | A1 | 2/2013 | Patel | |
| 2013/0153203 | A1* | 6/2013 | Lauderdale | E21B 17/06 166/55 |
| 2013/0153207 | A1* | 6/2013 | Lauderdale | E21B 17/07 166/123 |
| 2018/0073335 | A1 | 3/2018 | Patel | |
| 2023/0003093 | A1 | 1/2023 | Wakerley | |

FOREIGN PATENT DOCUMENTS

| | | | |
|---|---|---|---|
| RU | 2302509 | C2 | 7/2007 |
| RU | 2385407 | C2 | 3/2010 |
| RU | 106652 | U1 | 7/2011 |

OTHER PUBLICATIONS

Office Action and Search Report issued in Russian Patent Application No. 2022119421 dated Apr. 4, 2023, 18 pages with English translation.

* cited by examiner

CONTROL LINE ACTIVATED TUBING DISCONNECT LATCH SYSTEM

CROSS-REFERENCE TO RELATED APPLICATIONS

This application is a continuation of U.S. application Ser. No. 17/756,946, filed Jun. 6, 2022, which was a National Stage Entry of International Application No. PCT/RU2019/000953, filed Dec. 16, 2019, each of which is incorporated herein by reference in its entirety.

FIELD OF THE DISCLOSURE

Aspects of the disclosure relate to completions of wellbores for recovery of hydrocarbons from geological strata. More specifically, aspects of the disclosure relate to an arrangement and method that provide for wellbore separation of different sections of tubing through the use by an activated control line that shears a set of pins that connect the different sections of tubing together.

BACKGROUND

Hydrocarbon recovery from wellbores is becoming more difficult over time as easy to reach hydrocarbon reserves are depleted/exhausted. Operators, in order to reach new reserves, must drill deeper or through more difficult strata to reach alternative sources of hydrocarbons. Additionally, new reserves of hydrocarbons are being extracted from shale, therefore putting conventional drilling technology at risk as the new shale technologies become more cost effective.

Reaching hydrocarbon sources with a drill bit, however, is merely a first step in removing the hydrocarbons from those sources. A wellbore must be "completed" in order for the hydrocarbons to be successfully removed for long term production. Once drilling has stopped at a hydrocarbon source, for example, operators lower casing into the hole that is "hung" from the drilling platform or the surface. The purpose of the casing is to prevent the wellbore sides from collapsing in upon itself, thereby destroying the well. The casing may have different diameter sizes that are specially made to fit inside one another as the casing is progressively lowered into the wellbore down to the position where drilling stopped. As a leak tight production well is desired, further processing downhole must be accomplished to create a wellbore that is free from defects and leak tight.

During wellbore completions, the casing is freely hanging from the surface and must be anchored to allow the wellbore more stability. Such stability may include both vertical and lateral stability. To achieve this stability, the gap between the casing and the geological stratum must be filled with a material that will allow for shear and bending moment forces to be exerted on the casing. Such forces may occur during production (removal of the hydrocarbons), and therefore it is desired by operators to withstand anticipated kicks and service forces that may be exerted. Understandably, as wells grow deeper, hydrocarbon reserves are under more pressure, and therefore the possibility of having a large force on the casing and accompanying structures increases. A mixture of cementitious material is pumped down the wellbore, and the cementitious material flows out of the bottom of the hung casing and fills the annulus between the exterior face of the casing and the rough wellbore wall that was drilled. The cementitious material is then left to dry, creating an exterior sleeve of anchoring material between the wellbore wall and the hung casing.

After hardening, a second set of piping, called production tubing, is then lowered into the wellbore. The purpose of the production tubing is to accept the hydrocarbons emanating from the strata and convey these hydrocarbons to the surface. The production tubing may be held in place by packers placed within the casing and around the production tubing. This allows for the hydrocarbons to be extracted only through the production tubing while the hydrocarbons are prevented from only entering the casing of the well.

In order to start the flow of hydrocarbons into the well, an arrangement may be lowered into the well that will perforate both the tubing and the cementitious material as well as the geological formation. This arrangement, called a perforating gun, is used at a specific area where hydrocarbons are expected to be next to the wellbore. The perforations resulting from the actuations of the gun allow a free flow of hydrocarbons from the relatively higher pressure stratum into the lower pressure environment within the casing and production tubing, resulting in hydrocarbon flow into the casing and production tubing. As the production tubing is "packed off" within the casing, the hydrocarbons only enter the production tubing and travel to the surface where they are recovered by operators. As will be understood, the number of perforations from the perforating gun may vary according to the size of the wellbore, the pressure of the hydrocarbon reserve, the expected recovery of the amounts of hydrocarbons, and other variables.

As hydrostatic forces may be encountered during the drilling process, in some instances, a wellbore must be pressurized during the drilling process to prevent the relatively higher pressure hydrocarbons from immediately entering the wellbore. In these instances, a polished bore receptacle ("PBR") is used. The polished bore receptacle provides a sealing action and ensures isolation of liner string pressure. The polished bore receptacle has two primary functions. The PBR acts as an expansion joint and provides stroke length for extreme tubing movement during well treatment and production. The PBR also allows for removal of the production tubing string, while leaving a polished bore and anchor seal assembly set in a packer. When used as an expansion joint, the PBR is pinned in a "shear-up" position when assembled on a tubing string and then run in the wellbore above a packer. The number of pins used is determined by the weight of the tubing below the PBR. Thus, the pins must be of sufficient strength to sustain the weight of a slick joint when running the packer. The pins are sheared by the application of upper forces, in conventional applications. For example, the pinned system requires a force applied to the tubing to shear the pins. This can be in the form of an over pull or slack off. In other embodiments, separation of tubing may occur through a latch system that relies on pressure differential. In such embodiments, the tubing must be isolated or a packer must be set to allow for application of pressure to activate the unlatching process. In the cases of over pull or slack off, large forces are placed on the tubing, and such jarring can cause damage. The tubing, therefore, must be "over designed" to take such structural loading, resulting in expensive wellbore completion costs.

There is a need to provide apparatus and methods that are easier to operate than conventional apparatus, and methods where an over pull or slack off are not needed for unlatching activities.

There is a further need to provide apparatus and methods that do not have the drawbacks of a heavily designed tubing configuration used with conventional pin designs.

There is a further need to prevent other excessive activities related to tubing isolation pressure activities.

There is a further need to provide apparatus and methods for disconnection of tubing within a wellbore that is simple in operation so that operators can selectively choose to disconnect tubing.

There is also a need to provide a design that may be used with conventional unlatching systems as a failsafe system that will allow disconnection at the discretion of an operator if other methods for disconnection have failed.

There is a still further need to reduce economic costs associated with operations and apparatus described above with conventional tools.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one embodiment, a method for disconnecting production tubing at a polished bore receptacle is disclosed. The method may comprise placing the polished bore receptacle within a wellbore, the polished bore receptacle having a first section of tubing, a second section of tubing, and a tubing disconnect latch system connecting the first section of tubing and second section of tubing. The method may also comprise one of pressuring a control line with a fluid, the control line connected to a piston configured to travel from an unexpanded position to an expanded position and sending an electrical signal via an electrical control line connected to the piston, the piston configured to travel from an unexpanded position to an expanded position. The method may also comprise expanding the piston from the unexpanded position to the expanded position within the polished bore receptacle through one of fluid pressure and an electrical actuator connected to the piston. The method may further comprise shearing a set of pins connecting a collet with one of the first section of tubing and second section of tubing. The method may also provide for disconnecting the tubing disconnect latch system. The method may also comprise separating the first section of tubing from the second section of tubing.

In another embodiment, an arrangement is described. The arrangement comprises a polished bore receptacle and a first section of tubing within the polished bore receptacle. The arrangement further provides a second section of tubing within the polished bore receptacle. The arrangement is further configured with a collet configured to move from a first position to a second position and a tubing disconnect latch system connecting the first section of tubing to the second section of tubing, the latch system configured to move from a latched position to an unlatched position through contact with the collet in the first position. The arrangement is further configured with a piston configured to expand from an unexpanded position to an expanded position, the piston configured within the polished bore receptacle and a control line connected to the piston, the control line configured to actuate the piston. The arrangement is further configured with a set of pins configured to provide a resistance to the piston from expanding from the unexpanded position to the expanded position and movement of the collet from the first position to the second position, and wherein the set of pins is configured to shear at a predetermined shear value.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are therefore not be considered limiting of its scope, for the disclosure may admit to other equally effective embodiments.

Figure 1:
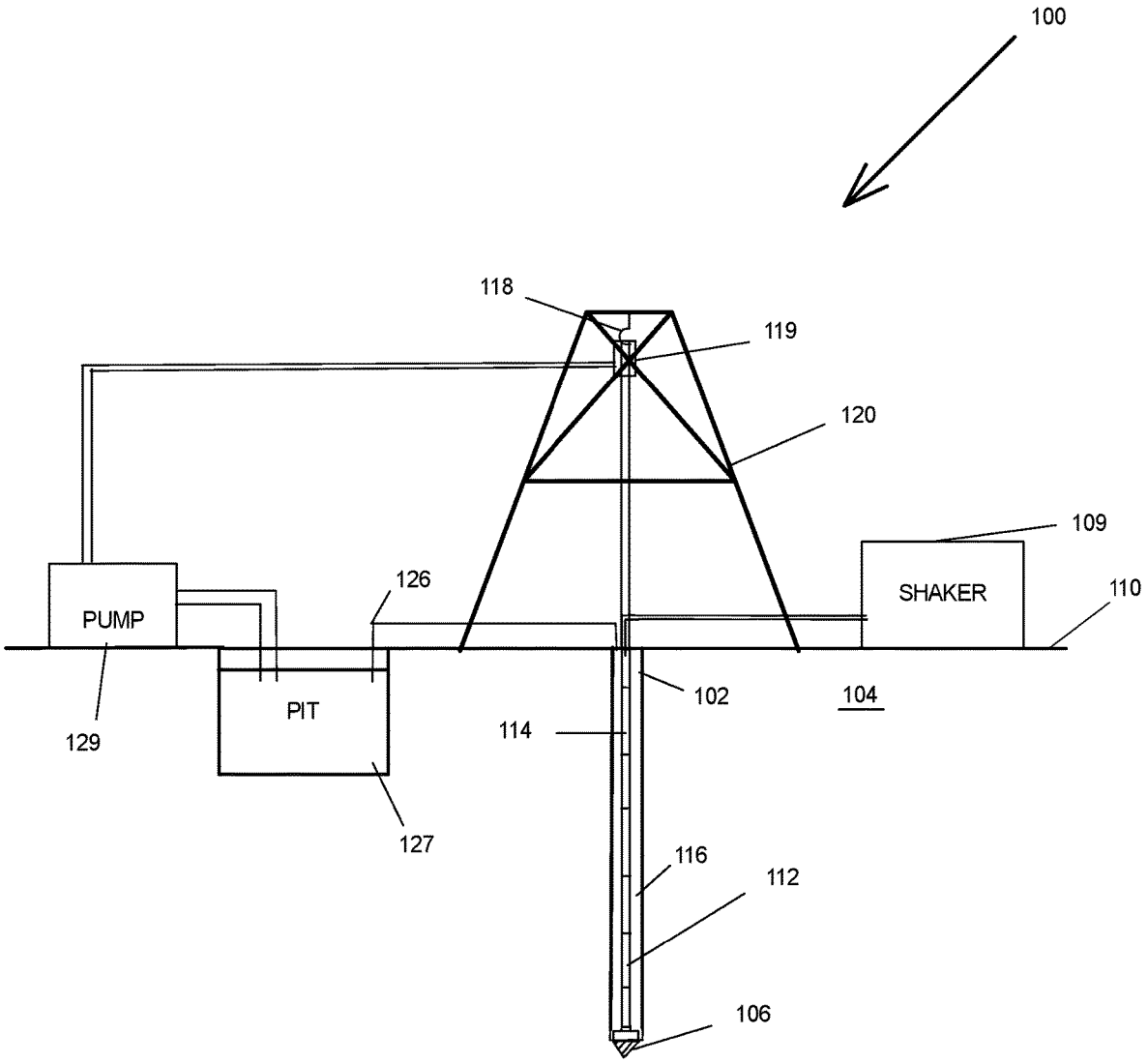
FIG. 1 is a drill rig performing a hydrocarbon recovery operation in one aspect of the disclosure.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims, except where explicitly recited in a claim. Likewise, reference to "the disclosure" shall not be construed as a generalization of inventive subject matter disclosed herein and shall not be considered to be an element or limitation of the claims, except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second", and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and\or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Aspects of the disclosure relate to a latching and unlatching system that is used in completions of wellbores created to recover hydrocarbons. First, the process of creating a wellbore with a drilling rig is described. Following the creation of the wellbore, a number of steps to "complete" the wellbore are described to start the wellbore flow of hydrocarbons. Differing types of technologies may be used in this completion activity, and the described embodiments should not be considered limiting. Wellbores may be completed when the wellbore is in a completely vertical orientation or may be completed in a horizontal orientation. Other variations of inclined wells may be completed. The aspects of the disclosure described provide a method of activation of the tubing separation through a control line. The use of a control line allows operators the ability to selectively determine when unlatching may occur. Such control line activation prevents over pulls or slack offs that are required with conventional apparatus. Eliminating over pulls or slack offs prevents damage to production tubing and limits economic costs.

Although described as a standalone system, the use of a control line for unlatching purposes may be retrofitted into a conventional apparatus. When retrofitted, the resulting apparatus provides a secondary method of disconnection of tubing, providing a greater degree of safety for operators. Thus, a retrofitted apparatus may be provided with a contingency release if components become stuck within a wellbore and disconnection between a top and bottom section of production tubing is desired. As will also be apparent, the apparatus and methods described are applicable on larger scale piping, therefore the use of the word "tubing" is merely used as a convention for description of piping of a smaller diameter.

In standalone arrangements described in accordance with the drawings, the aspects described relate to a single trip completion system. In general, single trip/single activation completion systems are not chosen for wellbores, as multiple action systems provide greater redundancy and safety. Such multiple action systems, however, can be costly to create and operate, leading to economic inefficiency. Aspects described herein provide a simplified completion design that minimizes risks of operators and enhances operational efficiency.

Referring to FIG. 1, a drilling rig 100 is illustrated. The purpose of the drilling rig 100 is to recover hydrocarbons located beneath the surface 110. Different stratum 104 may be encountered during the creation of a wellbore 102. In FIG. 1, a single stratum 104 layer is provided. As will be understood, multiple layers of stratum 104 may be encountered. In embodiments, the stratum 104 may be horizontal layers. In other embodiments, the stratum 104 may be vertically configured. In still further embodiments, the stratum 104 may have both horizontal and vertical layers. Stratum 104 beneath the surface 110 may be varied in composition, and may include sand, clay, silt, rock and/or combinations of these. Operators, therefore, need to assess the composition of the stratum 104 in order to maximum penetration of a drill bit 106 that will be used in the drilling process. The wellbore 102 is formed within the stratum 104 by a drill bit 106. In embodiments, the drill bit 106 is rotated such that contact between the drill bit 106 and the stratum 104 causes portions ("cuttings") of the stratum 104 to be loosened at the bottom of the wellbore 102. Differing types of drill bits 106 may be used to penetrate different types of stratum 104. The types of stratum 104 encountered, therefore, is an important characteristic for operators. The types of drill bits 106 may vary widely. In some embodiments, polycrystalline diamond compact ("PDC") drill bits may be used. In other embodiments, roller cone bits, diamond impregnated or hammer bits may be used. In embodiments, during the drilling process, vibration may be placed upon the drill bit 106 to aid in the breaking of stratum 104 that are encountered by the drill bit 106. Such vibration may increase the overall rate of penetration ("ROP"), increasing the efficiency of the drilling operations.

As the wellbore 102 penetrates further into the stratum 104, operators may add portions of drill string pipe 114 to form a drill string 112. As illustrated in FIG. 1, the drill string 112 may extend into the stratum 104 in a vertical orientation. In other embodiments, the drill string 112 and the wellbore 102 may deviate from a vertical orientation. In some embodiments, the wellbore 102 may be drilled in certain sections in a horizontal direction, parallel with the surface 110.

The drill bit 106 is larger in diameter than the drill string 112 such that when the drill bit 106 produces the hole for the wellbore 102, an annular space is created between the drill string 112 and the inside face of the wellbore 102. This annular space provides a pathway for removal of cuttings from the wellbore 102. Drilling fluids include water and specialty chemicals to aid in the formation of the wellbore. Other additives, such as defoamers, corrosion inhibitors, alkalinity control, bactericides, emulsifiers, wetting agents, filtration reducers, flocculants, foaming agents, lubricants, pipe-freeing agents, scale inhibitors, scavengers, surfactants, temperature stabilizers, scale inhibitors, thinners, dispersants, tracers, viscosifiers, and wetting agents may be added.

The drilling fluids may be stored in a pit 127 located at the drill site. The pit 127 may have a liner to prevent the drilling fluids from entering surface groundwater and/or contacting surface soils. In other embodiments, the drilling fluids may be stored in a tank alleviating the need for a pit 127. The pit 127 may have a recirculation line 126 that connects the pit 127 to a shaker 109 that is configured to process the drilling fluids after progressing from the downhole environment.

Drilling fluid from the pit 127 is pumped by a mud pump 129 that is connected to a swivel 119. The drill string 112 is suspended by a drive 118 from a derrick 120. In the illustrated embodiment, the drive 118 may be a unit that sits atop the drill string 112 and is known in the industry as a "top drive". The top drive is configured to provide the rotational motion of the drill string 112 and attached drill bit 106. Although the drill string 112 is illustrated as being rotated by a top drive, other configurations are possible. A rotary drive located at or near the surface 110 may be used by operators to provide the rotational force. Power for the rotary drive or the top drive may be provided by diesel generators.

Drilling fluid is provided to the drill string 112 through a swivel 119 suspended by the derrick 120. The drilling fluid exits the drill string 112 at the drill bit 106 and has several functions in the drilling process. The drilling fluid is used to cool the drill bit 106 and remove the cuttings generated by the drill bit 106. The drilling fluid with the loosened cuttings enters the annular area outside of the drill string 112 and travels up the wellbore 102 to a shaker 109. The drilling fluid provides further information on the stratum 104 being encountered and may be tested with a viscometer, for example, to determine formation properties. Such formation properties allow engineers the ability to determine if drilling should proceed or terminate.

The shaker 109 is configured to separate the cuttings from the drilling fluid. The cuttings, after separation, may be analyzed by operators to determine if the stratum 104 currently being penetrated has hydrocarbons stored within the stratum level that is currently being penetrated by the drill bit 106. The drilling fluid is then recirculated to the pit 127 through the recirculation line 126. The shaker 109 separates the cuttings from the drilling fluid by providing an acceleration of the fluid on to a screening surface. As will be understood, the shaker 109 may provide a linear or cylindrical acceleration for the materials being processed through the shaker 109. In embodiments, the shaker 109 may be configured with one running speed. In other embodiments, the shaker 109 may be configured with multiple operating speeds. In embodiments, shaker 109 may operate at multiple operating speeds. The shaker 109 may be configured with a low speed setting of 6.5 "g" and a high speed setting of 7.5 "g", where "g" is defined as the acceleration of gravity. Large cuttings are trapped on the screens, while the drilling fluid passes through the screens and is captured for reuse. Tests may be taken of the drilling fluid after passing through the shaker 109 to determine if the drilling fluid is adequate to reuse. Viscometers may be used to perform such testing.

As will be understood, smaller cuttings may pass entirely through the screens of the shaker 109 such that the fluids may include many smaller size cuttings. The overall quality of the drilling fluid, therefore, may be compromised by such smaller cuttings. The drilling fluid may be, as example, water based, oil based, or synthetic based types of fluids. The fluid provides several functions, such as the capability to suspend and release cuttings in the fluid flow, the control of formation pressures (pressures downhole), maintain wellbore stability, minimize formation damage, cool, lubricate and support the bit and drilling assembly, transmission of energy to tools and the bit, control corrosion and facilitate completion of the wellbore. In embodiments, the drilling fluid may also minimize environmental impact of the well construction process.

Figure 2:
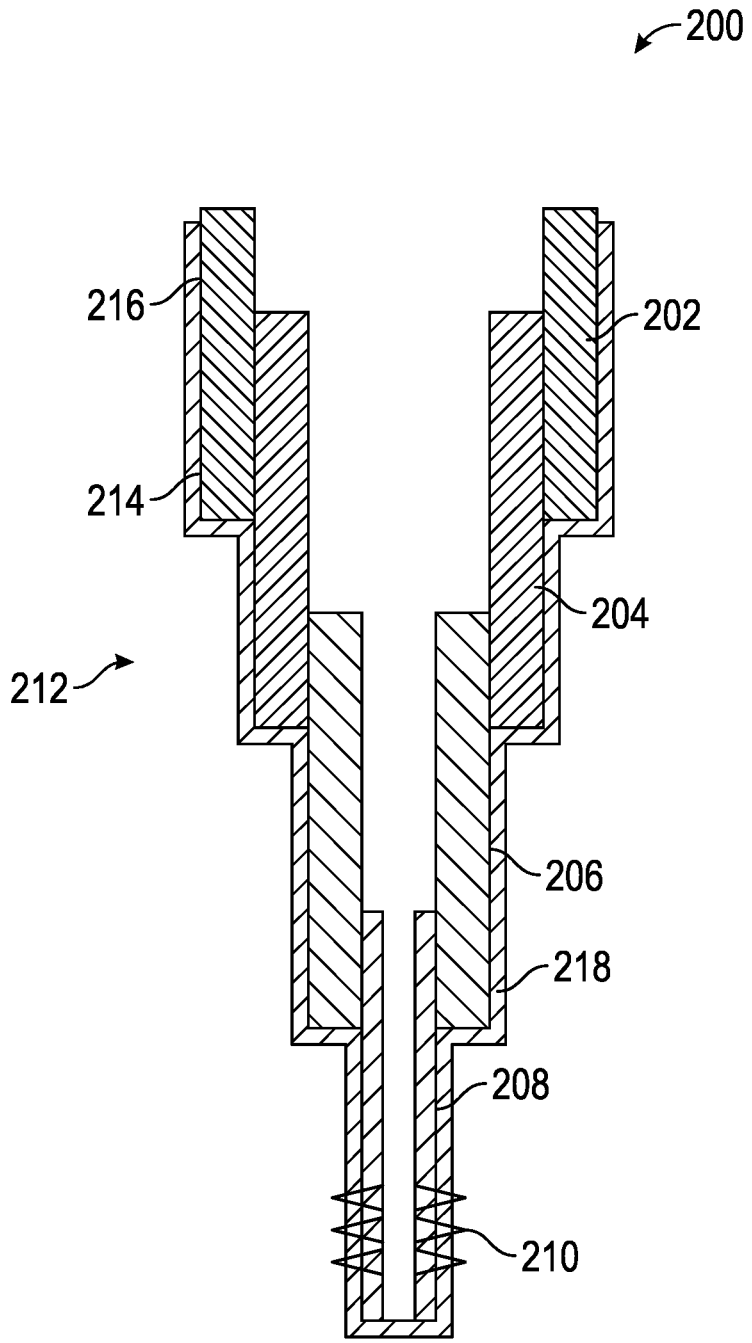
FIG. 2 is a cross-section of a completed well in one aspect of the disclosure.

Referring to FIG. 2, a cross-section of a completed well 200 is illustrated when drilled as described above. The completed well 200 has several sections of casing that provide support for the overall well 200 to allow hydrocarbons 212 trapped below a surface geological stratum 214. The hydrocarbons 212 may be oil, gas or a mixture of gas and oil. A base or conductor pipe 202 extends from the surface 216 and provides a sturdy connection point of the remainder of the well 200. Extending below the conductor pipe 202 is a section of surface casing 204, followed by intermediate casing 206 and production casing 208. At the bottom of the well 200, a perforated interval 210 allows the hydrocarbons 212 to enter the production tubing, described in connection with FIG. 3, that resides within the production casing 208. As will be seen, a cementitious layer 218 encases the exterior portions of the conductor pipe 202, surface casing 204, intermediate casing 206 and production casing 208 in areas that do not include perforated interval 210.

Figure 4:
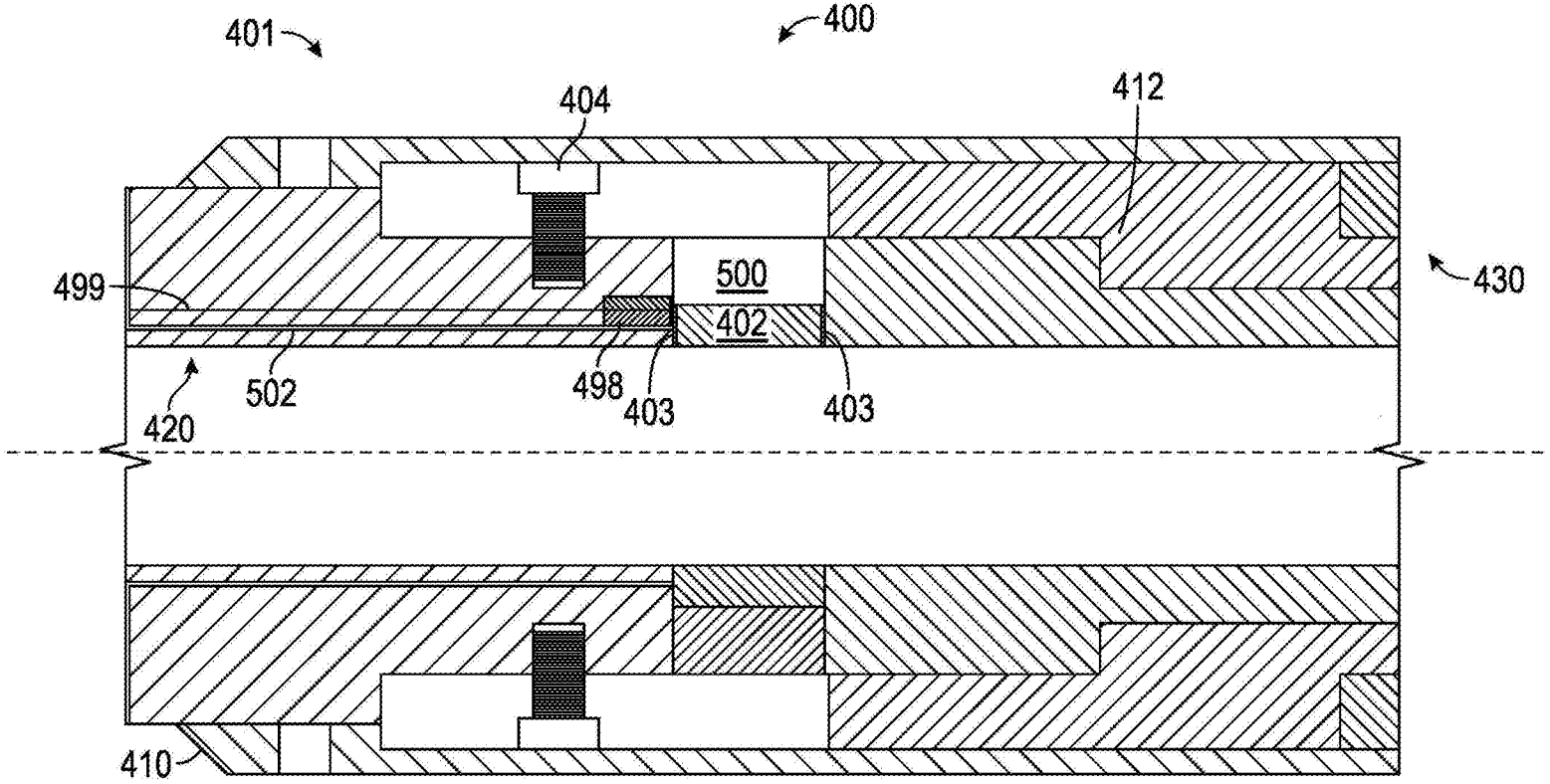
FIG. 4 is a cross-section of a downhole section of a control line activated tubing disconnect latch system in accordance with one example embodiment of the disclosure.

A PBR 410, see FIG. 4, may be used on the inside diameter of the casing to prevent fluids from traveling up-hole during the drilling process described above in relation to FIG. 1. The PBR 410 is provided with a honed interior and exterior diameter to provide sealing surfaces. Production tubing sealing assemblies may be lowered on to the polished bore receptacle for connection of tubing further downhole from the PBR 410. The PBR 410 isolates the liner inside diameter from formation pressure that forces out cement during the cementing process, described above. As the PBR 410 is used for production tubing sealing assemblies, disconnecting tubing to and from the PBR 410 is accomplished through aspects described below.

Figure 3:
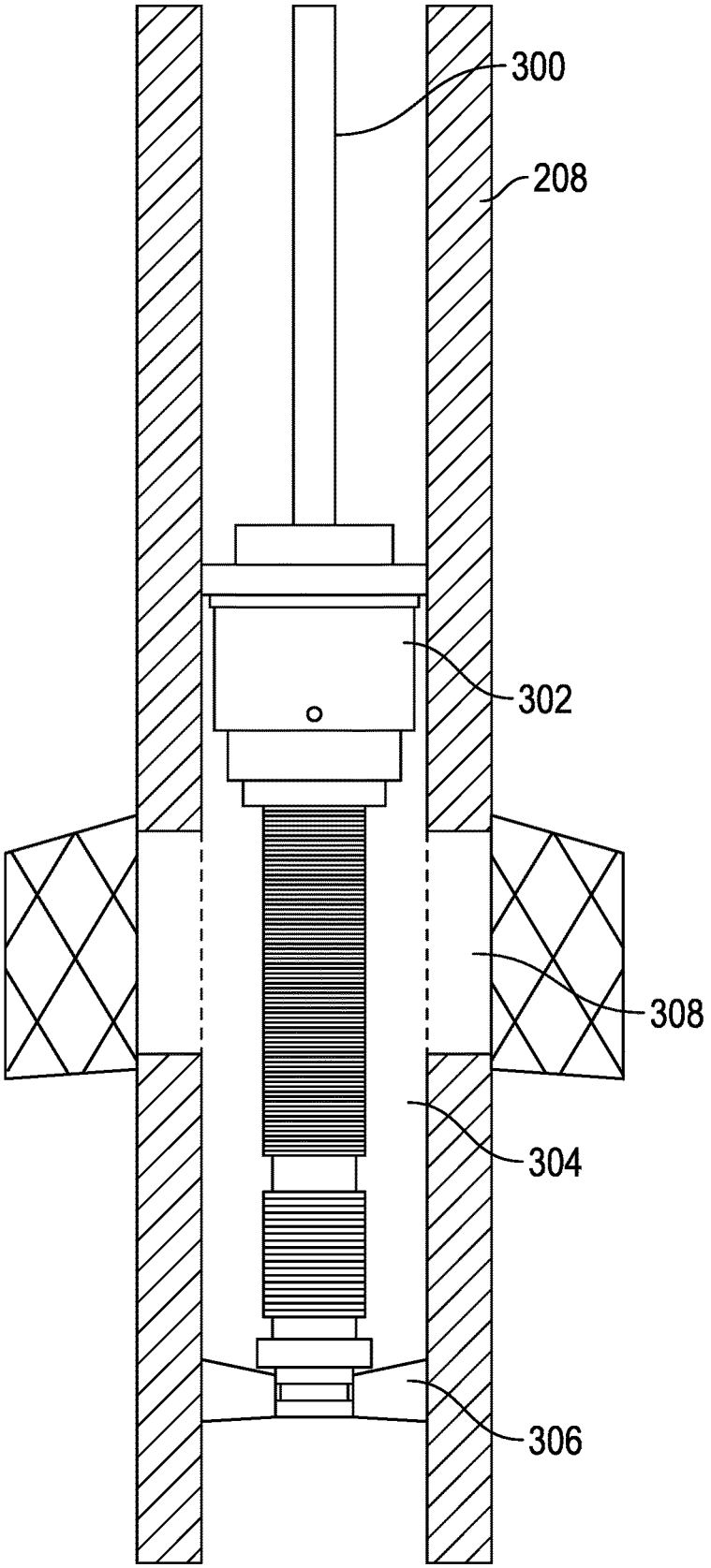
FIG. 3 is a cross-section of a packer installation connected to production tubing and production casing.

Referring to FIG. 3, a cross-section of a gravel pack used in connection with the completed well 200 is illustrated. Within the production casing 208, production tubing 300 is run to accept hydrocarbons 212 (Sec FIG. 2). In non-limiting embodiments, production tubing 300 may be 1⅞ inch (4.76 cm) to 2⅞ inch (7.3 cm) in diameter. In order to limit the amount of sand and fines that enter the wellbore, a gravel-pack packer 302 may be located in the vicinity of the perforated interval 210 (See FIG. 2). A gravel pack screen 304 may be positioned within the well 200 to provide for filtering of larger materials from entering the well 200. A sump packer 306 may also be placed at the bottom of the well 200 so that the gravel pack screen 304 may be located on the perforated interval 210 (Sec FIG. 2). Gravel may be placed in the casing and perforations 308 in the perforated interval 210 (See FIG. 2). As will be understood, different configurations may be used at the bottom of production tubing 300.

Referring to FIG. 4, a partial cross-section of an arrangement 401 having a tubing disconnect latch system 400 is illustrated as part of a PBR 410. The tubing disconnect latch system 400 is activated via a control line 502, see FIG. 5, that applies a fluid pressure to a release piston 402 in the latch 400 to shear a set of pins 404, thereby disengaging the latch system 400 when a collet 412 engages the latch system 400. The release piston 402 has a set of o-rings 403 to maintain pressure within the piston 402 as it moves. In the illustrated embodiment, 2 o-rings are provided. The production tubing 300 may be disconnected without requiring tubing isolation to pressure up and creating a tubing annulus pressure differential. This arrangement of the latch 400 also alleviates the need for a set packer to create a differential pressure used in conventional apparatus. The fluid pressure exerted via the control line 502 may be through a pump 550 or an accumulator 560 that is controlled by an operator (See FIG. 5). As will be understood, the pressure provided to the control line 502 may be reduced or eliminated once the set of pins 404 is sheared. In embodiments, operators will notice a reduction in pressure of the control line once the set of pins 404 are sheared and the hydraulic volume of the piston 402 increases. At this point, the operators may decrease the pressure in the control line 502 allowing for unlatching to proceed. As will be understood, materials used for the PBR 410, the collet 412, and release piston 402 may be made of stainless steel.

Aspects of the disclosure provide a method for disconnecting a tubing disconnect latch system 400 that works independently from tubing forces, wherein tail pipe weight and tubing manipulation do not activate the release mechanism. A release piston 402 is held in position by the set of pins 404. The pins 404 prevent premature activation of the release piston 402. Once the set of pins 404 are sheared, the piston 402 expands and pressure is released. A collet 412 is freed and moves to disengage the tubing disconnect latch system 400, thereby parting the tubing 300 at a polished bore receptacle 410. A first section of tubing 420 is released from a second section of tubing 430. The tubing disconnect latch system 400 may be enclosed in a polished bore receptacle 410, as illustrated.

Figure 5:
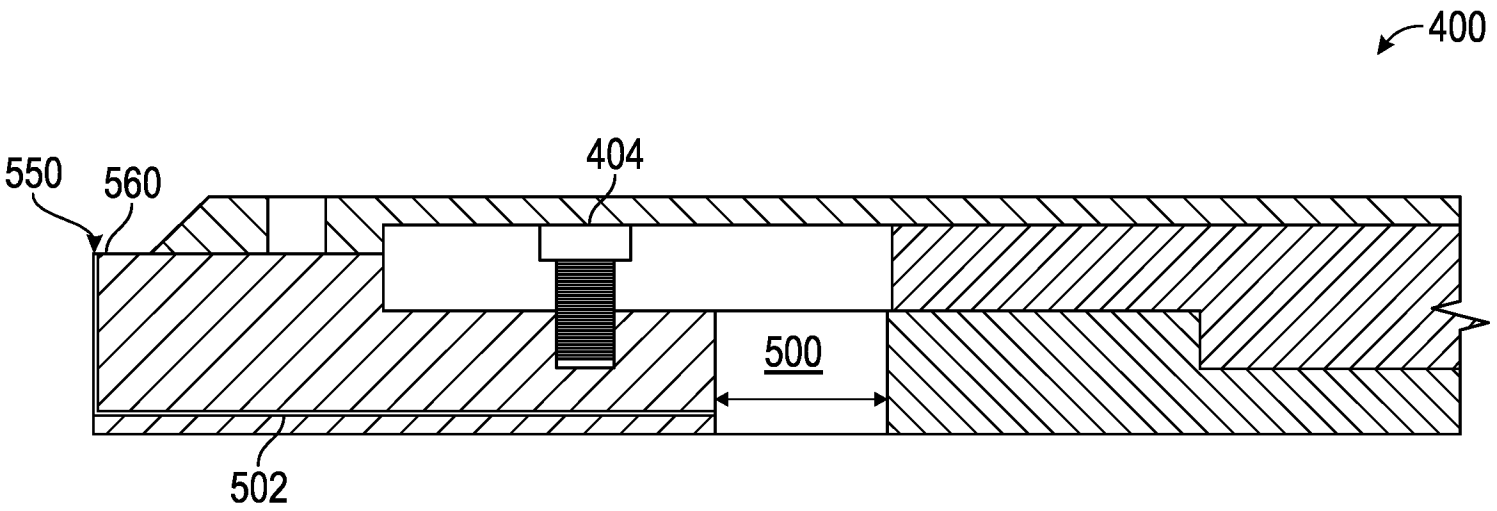
FIG. 5 is an expanded cross-section of an up-hole section of a control line activated tubing disconnect latch system later in accordance with one example embodiment of the disclosure.

Referring to FIG. 5, an atmospheric chamber 500 is provided within the polished bore receptacle 410. The purpose of the atmospheric chamber 500 may be provided to ensure a contingency release is absolute annulus pressure. Pressure may be provided to the polished bore receptacle 410 through a control line 502 via a port on an outside of the polished bore receptacle 410. The pressure may come from a first environment, namely at the drill rig 100 and pumped down to the tubing disconnect latch system 400.

As a differential pressure is not generated through use of a packer, actuation of the tubing disconnect latch system 400 is quicker and more economical than conventional apparatus. Manufacturing the tubing disconnect latch system 400 including the collet 412 and the atmospheric chamber 500 is economical. Variations of the strength needed for disengagement for the first section of tubing 420 from the second section of tubing 430 may be achieved by providing different materials within the set of pins 404, or by increasing or reducing the size of the pins 404. As will be understood, aspects of the tubing disconnect latch system 400 may be increased or decreased in size according to the flow needs of the well 200. As is provided in FIG. 5, the set of pins 404 is at least partially recessed in the first section of tubing 420. In FIGS. 4 and 5, the set of pins 404 connect the first section of tubing 420 and the collet 412.

In other embodiments, referring to FIG. 4, actuation may be through provision of an electrical signal sent down an electrical control line 499 to an actuator 498 that actuates the piston 402. The actuator 498 may be located in a downhole portion of the drill string 112. The actuator 498 may be connected to the piston 402 such that upon receipt of a signal, the actuator 498 moves the piston 402 to a position according to the signal received. In one non-limiting embodiment, the piston 402 may be positioned in a fully open position and in a fully closed position. In another non-limiting embodiment, the piston 402 may be positioned through a gradation of positions from fully open to fully closed. In some embodiments, signals may be generated by the actuator 498 thereby identifying to an operator the exact positioning of the piston 402 to provide real time updates to operators. Such positioning data may be useful, for example, in identifying if an error or fault has occurred in the system during operations. In some embodiments, both an electrical system actuation and a fluid pressure actuation may be used. Such a configuration would allow for a single failure proof design that would ensure piston 402 actuation in extreme wellbore conditions. In embodiments, the actuator 498 may be an electric linear actuator that is controlled by a relay or control module that may be located either in the uphole environment or downhole. Power may be supplied to the electric linear actuator through a power supply fed through a drilling rig or auxiliary electrical power source. In other embodiments, battery power may be supplied as the electric power source to prevent inadvertent power loss.

Figure 6:
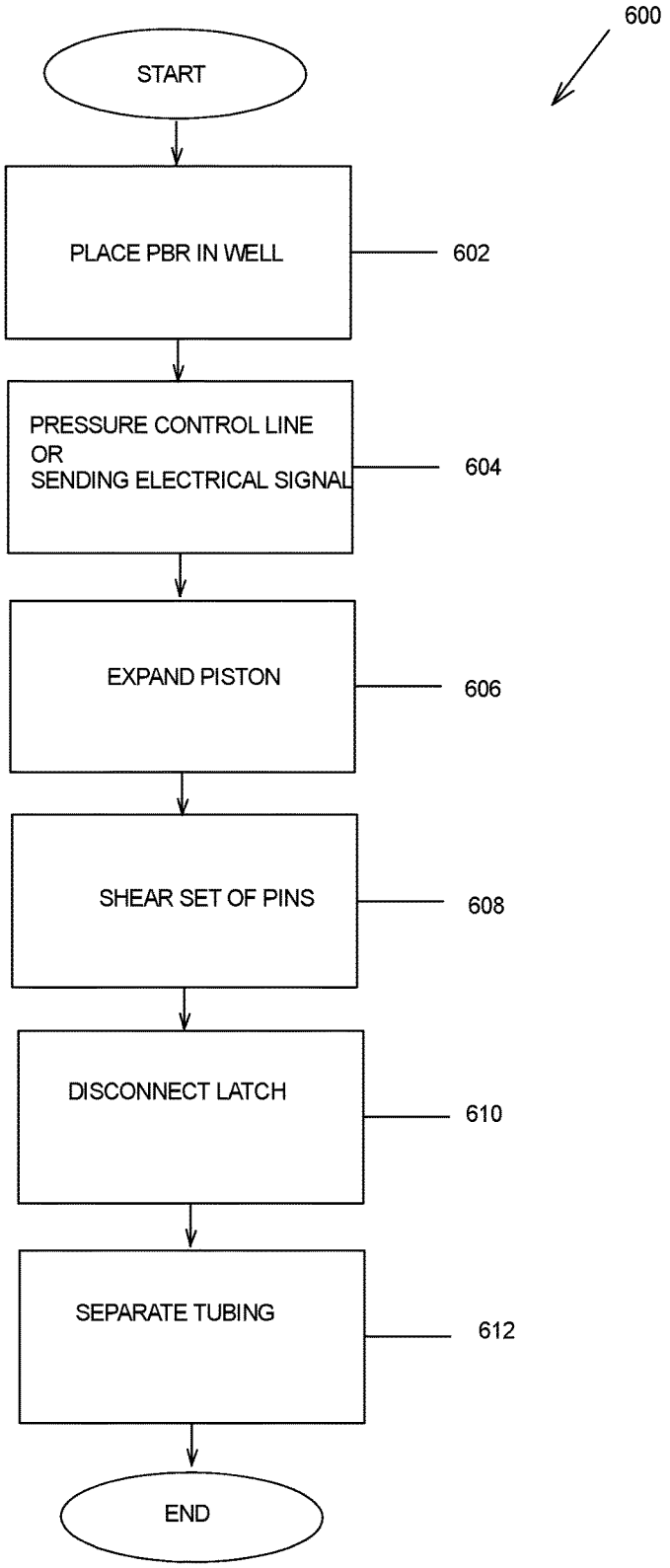
FIG. 6 is a method flow chart for disconnecting tubing in a downhole environment.

Referring to FIG. 6, a method 600 for disconnecting production tubing at a polished bore receptacle is illustrated. At 602, the method includes placing the polished bore receptacle within a wellbore, the polished bore receptacle having a first section of tubing, a second section of tubing, and a tubing disconnect latch system. At 604, the method further includes one of pressuring a control line with a fluid, the control line connected to a piston configured to travel from an unexpanded position to an expanded position and sending an electrical signal via an electrical control line connected to the piston, the piston configured to travel from an unexpanded position to an expanded position. At 606, the method provides for expanding the piston from the unexpanded position to the expanded position within the polished bore receptacle through one of fluid pressure and an electrical actuator connected to the piston. At 608, the method provides shearing a set of pins connecting a collet with one of the first section of tubing and second section of tubing. At 610, the method provides for disconnecting the tubing disconnect latch system. At 612, the method provides for separating the first section of tubing from the second section of tubing.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

In one embodiment, a method for disconnecting production tubing at a polished bore receptacle is disclosed. The method may comprise placing the polished bore receptacle within a wellbore, the polished bore receptacle having a first section of tubing, a second section of tubing, and a tubing disconnect latch system connecting the first section of tubing and second section of tubing. The method may also comprise one of pressuring a control line with a fluid, the control line connected to a piston configured to travel from an unexpanded position to an expanded position and sending an electrical signal via an electrical control line connected to the piston, the piston configured to travel from an unexpanded position to an expanded position. The method may also comprise expanding the piston from the unexpanded position to the expanded position within the polished bore receptacle through one of fluid pressure and an electrical actuator connected to the piston. The method may further comprise shearing a set of pins connecting a collet with one of the first section of tubing and second section of tubing. The method may also provide for disconnecting the tubing disconnect latch system. The method may also comprise separating the first section of tubing from the second section of tubing.

In a further example embodiment, the method may be performed wherein the fluid is a liquid.

In a further example embodiment, the method may be performed wherein the set of pins is two pins.

In a further example embodiment, the method may be performed wherein the pressuring the control line with the fluid is performed in an up-hole environment.

In a further example embodiment, an arrangement is disclosed. The arrangement may comprise a polished bore receptacle, a first section of tubing within the polished bore receptacle, and a second section of tubing within the polished bore receptacle. The arrangement may further comprise a collet configured to move from a first position to a second position, and a tubing disconnect latch system connecting the first section of tubing to the second section of tubing, the tubing disconnect latch system configured to move from a latched position to an unlatched position through contact with the collet in the first position. The arrangement may further comprise a piston configured to expand from an unexpanded position to an expanded position, the piston configured within the polished bore receptacle and a control line connected to the piston, the control line configured to convey a fluid from a first environment to the piston. The arrangement may also comprise a set of pins configured to provide a resistance to the piston from expanding from the unexpanded position to the expanded position and movement of the collet from the first position to the second position, and wherein the set of pins is configured to shear at a predetermined shear value.

In a further example embodiment, the arrangement may be configured wherein the set of pins comprises two pins.

In a further example embodiment, the arrangement may also further comprise an atmospheric chamber positioned within the polished bore receptacle, the atmospheric chamber connected to the piston.

In a further example embodiment, the arrangement may further comprise a pump connected to the control line configured to transfer the fluid from the first environment to the piston.

In a further example embodiment, the arrangement may further comprise an accumulator connected to the control line configured to transfer the fluid from the first environment to the piston.

In a further example embodiment, the arrangement may also be configured wherein the piston is configured with a set of o-rings.

In a further example embodiment, the arrangement may also be configured wherein the control line is one of a hydraulic control line and an electric control line.

In a further example embodiment, the arrangement may also be configured wherein the piston is configured to contact at least a portion of the first section of tubing.

In a further example embodiment, the arrangement may also be configured wherein the set of pins connects the first section of tubing and the collet.

In a further example embodiment, the arrangement may be configured wherein the set of pins is at least partially recessed in the first section of tubing.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A method for disconnecting production tubing at a polished bore receptacle, comprising:

actuating a piston, via a control line, to travel from a first position to a second position within a polished bore receptacle within a wellbore, wherein the polished bore receptacle comprises a tubing disconnect latch system connecting first and second sections of tubing; and shearing a set of pins to release the tubing disconnect latch system in response to the travel of the piston from the first position to the second position.

2. The method according to claim 1, wherein actuating the piston via the control line comprises transmitting an electric signal through the control line to actuate the piston via an electric actuator.

3. The method according to claim 1, wherein the set of pins is two pins.

4. The method according to claim 1, wherein actuating the piston via the control line comprises controlling actuation of the piston remotely from a drill rig or an up-hole environment.

5. The method of claim 1, further comprising:

running the polished bore receptacle into the wellbore; and separating the first and second sections of tubing in response to the release of the tubing disconnect latch system.

6. The method of claim 1, wherein actuating the piston via the control line comprises flowing a fluid through the control line to actuate the piston via a fluid pressure.

7. The method of claim 6, further comprising reducing the fluid pressure after shearing the set of pins.

8. The method of claim 1, wherein the set of pins extends radially between the first section of tubing and the polished bore receptacle.

9. The method of claim 1, wherein actuating the piston comprises actuating an actuator coupled to the control line and the piston.

10. An arrangement, comprising:

a polished bore receptacle;

a first section of tubing within the polished bore receptacle;

a second section of tubing within the polished bore receptacle;

a collet configured to move from a first collet position to a second collet position;

a tubing disconnect latch system connecting the first section of tubing to the second section of tubing, the tubing disconnect latch system configured to move from a latched position to an unlatched position through contact with the collet in the first collet position;

a piston configured to travel from a first piston position to a second piston position, the piston configured within the polished bore receptacle;

a control line connected to the piston, the control line configured to actuate the piston; and a set of pins configured to shear to release the tubing disconnect latch system in response to the travel of the piston from the first piston position to the second piston position and movement of the collet from the first collet position to the second collet position, and wherein the set of pins is configured to shear at a predetermined shear value.

11. The arrangement according to claim 10, wherein the set of pins comprises two pins.

12. The arrangement according to claim 10, further comprising:

an atmospheric chamber positioned within the polished bore receptacle, the atmospheric chamber connected to the piston.

13. The arrangement according to claim 10, further comprising:

a pump connected to the control line and configured to transfer a fluid from a first environment to the piston.

14. The arrangement according to claim 10, further comprising:

an accumulator connected to the control line and configured to transfer a fluid from a first environment to the piston.

15. The arrangement according to claim 10, wherein the piston is configured with a set of o-rings.

16. The arrangement according to claim 10, wherein the control line is a hydraulic control line or an electric control line.

17. The arrangement according to claim 15, wherein the piston is configured to contact at least a portion of the first section of tubing.

18. The arrangement according to claim 17, wherein the set of pins connects the first section of tubing and the polished bore receptacle.

19. The arrangement according to claim 18, wherein the set of pins is at least partially recessed in the first section of tubing.

20. The arrangement according to claim 10, wherein the collet is made of stainless steel.

* * * * *